US007093730B2

(12) United States Patent
Saint-Gerand

(10) Patent No.: US 7,093,730 B2
(45) Date of Patent: Aug. 22, 2006

(54) TOWER CRANE WITH COLLAPSIBLE COUNTER-JIB

(75) Inventor: Jean-Claude Saint-Gerand, Ecully (FR)

(73) Assignee: Potain, Ecully (FR)

( * ) Notice: Subject to any disclaimer, the term of this patent is extended or adjusted under 35 U.S.C. 154(b) by 294 days.

(21) Appl. No.: 10/410,355

(22) Filed: Apr. 10, 2003

(65) Prior Publication Data

US 2003/0217985 A1 Nov. 27, 2003

(30) Foreign Application Priority Data

May 21, 2002 (FR) ..... 02 06170

(51) Int. Cl.
*B66C 23/34* (2006.01)

(52) U.S. Cl. ..... 212/295; 212/300

(58) Field of Classification Search ..... 212/295–297
See application file for complete search history.

(56) References Cited

U.S. PATENT DOCUMENTS

| | | | | |
|---|---|---|---|---|
| 3,357,572 | A * | 12/1967 | Yoshioka | 212/296 |
| 3,378,147 | A * | 4/1968 | Marrie | 212/296 |
| 4,596,336 | A * | 6/1986 | Zwagerman | 212/296 |
| 4,895,263 | A | 1/1990 | Saint Gerand | |
| 6,276,541 | B1 * | 8/2001 | Gevaudant | 212/300 |
| 6,290,078 | B1 * | 9/2001 | Verchere | 212/300 |
| 6,655,539 | B1 * | 12/2003 | Bertinotti | 212/300 |
| 2003/0160016 | A1 * | 8/2003 | Ortiz et al. | 212/300 |

FOREIGN PATENT DOCUMENTS

| | | | |
|---|---|---|---|
| DE | 36 33 582 | A | 4/1987 |
| EP | 0 888 997 | A | 1/1999 |
| EP | 0 941 958 | A1 * | 9/1999 |
| FR | 1 564 958 | A | 4/1969 |
| FR | 2 550 176 | A | 2/1985 |

OTHER PUBLICATIONS

Societe POTAIN, "Erection/Dismantling manual for the "GMR 321 C" crane model," pp. 21, 25, 48 and 51, 1989.

* cited by examiner

*Primary Examiner*—Thomas J. Brahan
(74) *Attorney, Agent, or Firm*—Oliff & Berridge, PLC

(57) ABSTRACT

The auto-erection tower crane possesses a tie-free jib, mounted at the summit of a mast and extended, toward the rear of its connection point to the summit of the mast, by a counter-jib, the end of which is connected, by a rear tie, to a bogie truck element of the crane. For the transport of the crane, the counter-jib is folded up in a vertical plane on the rear part of the jib. The unfolding and folding-up of the counter-jib are realized automatically, simultaneously with the automatic erection or dismantling of the crane. The structure of the counter-jib also allows adjustment of the working position, horizontal or inclined, of the jib.

11 Claims, 5 Drawing Sheets

29
14
21
20
21
31
32
33
14
26
10
25
29
28
27
30
39
20
36
46
40
41
37
42
22
43
19
9
23
24
44
35
45
38
11
47

29
21
20
14
IV
27
19
22
9
47
11

20
14
III
22
19
6
10
47
11
4
II
22
14
10
47
11
8
10
19
6
17
15
5
14
11
18
16
I
5
8
10
47
2
6
7
4
5

TOWER CRANE WITH COLLAPSIBLE COUNTER-JIB

BACKGROUND OF THE INVENTION

The present invention relates, in general terms, to the field of tower cranes and more particularly to auto-erection tower cranes, having a tie-free jib and a collapsible counter-jib. Still more particularly, the present invention relates to a device which, in such a crane, in the erection and dismantling operations, ensures automatic unfolding and folding-up of the counter-jib in the vertical plane of the jib.

DESCRIPTION OF THE PRIOR ART

In a crane of the kind here discussed, and in a generally known manner, the jib mounted at the summit of the mast is extended in the working position, toward the rear of its connection point with the summit of the mast, by a counter-jib of substantially shorter length than that of the jib. In the working position of the crane, the counter-jib is joined to the jib and the and of this counter-jib is connected, by a rear tie, to a bogie truck element (in particular to the revolving underframe) of the crane. By regulating the length of the rear tie, it is possible to adjust the angle of inclination of the jib.

In a crane of this kind, in order to reduce the bulk size in the folded-up transport position of the crane, it is already known to design the counter-jib so that it collapses. The prior art teaches a counter-jib which is collapsible in a horizontal plane, about a vertical hinge, to end up positioned on the side of the rear part of the jib of the crane. This lateral folding-up of the counter-jib, and its unfolding from the folded-up transport position, are manually performed operations.

In illustration of this prior art, reference can be made to the erection/dismantling manual for the "GMR 321C" crane model, published in 1989 by la Société POTAIN, in particular pages 21, 25, 48 and 51 of this manual.

The current state of the art has various drawbacks:

- Because of the forces involved in the lateral folding-up of the counter-jib, the bulk size of the folded-up crane in terms of width is considerable.
- The folding-up or unfolding of the counter-jib in a horizontal plane, by pivoting about a vertical hinge, calls for considerable ground space.
- This folding-up or unfolding calls for manual intervention, which is time-consuming and labour-intensive, in the crane erection and dismantling operations.
- The folding-up of the counter-jib for the transport position of the crane gives a "slack" to the rear tie, which consequently has to be manually attached to the metallic structure of the crane.

SUMMARY OF THE INVENTION

The present invention sets out to rectify all these drawbacks by providing a collapsible counter-jib system of different design which allows a reduction in the limit gauge of the folded-up crane for its transport, which also reduces the necessary ground space for the unfolding or folding-up of the counter-jib and which, moreover, allows this unfolding or folding-up to be rendered automatically and simultaneously with the unfolding or folding-up of the whole of the crane.

To this end, the subject of the invention is essentially a tower crane having a collapsible counter-jib, of the kind indicated in the introduction, in which, for the transport of the crane, the counter-jib is folded up in a vertical plane on the rear part of the jib, the unfolding and folding-up of the counter-jib being realized automatically, simultaneously with the automatic erection or dismantling of the crane.

Thus, according to a first embodiment of the invention, the counter-jib is arranged such as to be able to be tilted down on the rear part of the jib, by a motion executed in the vertical plane of this jib.

This can be attained, according to a preferred embodiment of the invention, with a counter-jib comprising a lower part, articulated about a horizontal axis on the rear end of the jib, and a telescopic upper part, articulated about a horizontal axis, situated above the previous axis, on the rear end of the jib, the respective rear ends of the lower part and the telescopic upper part being hinge-connected one to the other on a horizontal axis, to which is attached the upper end of the rear tie.

In side view, the counter-jib thus has the shape of a triangle rendered deformable by lengthening or shortening of one of its sides, thereby allowing this counter-jib to be tilted down on the rear part of the jib.

According to one particular embodiment, the counter-jib possesses a structure in the general shape of a trihedron, its lower part being in the shape of an elongated isosceles triangle, hinge-connected by its base to the rear end of the jib, and its upper part being constituted by a telescopic tie, composed of an anterior element hinge-mounted on the rear end of the jib and a posterior element hinge-mounted on the summit of the triangular lower part such as to form that point of the trihedron to which is attached the upper end of the rear tie.

Such a configuration of the counter-jib is particularly suitable in the case of a crane with jib, at least the foot of which jib is triangular in section, having two lower chords and one upper chord; in this case:

- the lower part of the triangular counter-jib is hinge-mounted by its base on the rear ends of the two lower chords of the jib foot,
- the anterior element of the telescopic tie, constituting the upper part of the counter-jib, is hinge-mounted on the jib foot at the level of the rear end of its upper chord, and
- in folded-up transport position, the triangular lower part is tilted down obliquely on the jib foot, its summit being situated on the upper chord of the jib foot, whilst the upper part constituted by the telescopic tie is tilted down horizontally on this upper chord.

Thus, in the folded-up transport position, the counter-jib is perfectly "encased" on the jib foot.

Advantageously, the telescopic upper part of the counter-jib includes means for adjusting its telescoping travel, for preselection of the horizontal position or of more or less inclined positions of the jib, in the working configuration of the crane.

In particular, where the upper part of the counter-jib is constituted by a telescopic tie, the means for adjusting the telescoping travel includes, on one of the elements of the telescopic tie, a longitudinal slot and, on the other element of the telescopic tie, a plurality of adjusting holes provided to receive a stop pin cooperating with an end of the slot.

Thanks to such measures, the working configurations with substantially horizontal jib, or with more or less raised jib, are chosen prior to erection of the crane, by adjusting the length of travel of the telescopic tie. The maximum travel corresponds to the "substantially horizontal jib" configuration. The intermediate travels correspond to the "raised jib" configurations.

According to another advantageous embodiment of the present invention, the crane includes a motorized device for folding up and controlling the unfolding of the counter-jib, said motorized device being mounted between the rear part of the jib and a part of the counter-jib. This motorized device completes the action of the rear tie and the action of the own weight of the counter-jib in order to realize the automatic unfolding and folding-up of the counter-jib, simultaneously with the automatic erection of the crane and, in particular, simultaneously with the unfolding or folding-up of the mast of the crane (in the case of a crane with flexible mast, especially made up of two articulated elements).

According to one embodiment, the motorized device for folding up and controlling the unfolding of the counter-jib is composed of a gas spring and a connecting rod assembly. In a still more particular embodiment;

- the gas spring is hinge-mounted by one end, about a horizontal axis, on an element of the rear part of the jib,
- this gas spring is hinge-mounted by its other end, about a horizontal axis, on one end of a three-point connecting rod,
- the connecting rod is articulated at an intermediate point, about a horizontal axis, on an element of the rear part of the jib, and
- a linkage connects the other end of the connecting rod to the lower part of the counter-jib.

Advantageously, the linkage is constituted by a short connecting rod and a long connecting rod, mutually hinge-connected in traction along a horizontal axis, the short connecting rod being hinge-connected about a horizontal axis to said other end of the three-point connecting rod, whilst the long connecting rod is articulated, about a horizontal axis, at an intermediate point of the length of the lower part of the counter-jib.

The motorization device, with gas spring and connecting rod assembly, ensures in particular the following functions:

- In the course of erection of the crane, between a "slightly forward inclined" position of the counter-jib and the chosen working position, this motorization device exerts a control by braking the unfolding motion of the counter-jib, whilst keeping the rear tie taut (the motorization device only acting between these two positions).
- In the course of dismantling of the crane, when the jib comes to rest upon the mast, the same device enters into action to swing the counter-jib forward until the "slightly forward inclined" position (position beyond which the own weight of the counter-jib suffices to fold it up fully on the rear of the jib), whilst keeping the rear tie taut.

All in all, the collapsible counter-jib system, the subject of the present invention, possesses the following advantages:

The proposed system allows complete folding-up of the counter-jib, in the transport position of the crane, the folded-up counter-jib becoming incorporated in the limit gauge of the jib, with virtually no increase in either its length or its height.

The counter-jib is folded up and unfolded by swinging in the vertical plane of the jib, thereby obviating the need for additional ground space.

Furthermore, these folding-up and unfolding operations are realized automatically, in the course of the crane dismantling or re-erection sequence, such that they require neither manual effort, nor labor, and require no additional time.

Insofar as the motorization of the folding-up and unfolding of the counter-jib is realized, in combination, by the rear tie, by the own weight of the counter-jib and by a motorization device with gas spring, this motorization remains all in all simple and requires neither particular maintenance, nor external energy supply for its working.

Moreover, the proposed system allows the crane to be fully folded up with a totally negligible "slack" in the rear tie, making it unnecessary to attach this rear tie to a metallic structure.

This system also eliminates the dynamic effects in the folding-up and unfolding operations of the counter-jib.

Finally, in the working position of the crane, configurations with the jib unclaimed can be very easily obtained with this system.

BRIEF DESCRIPTION OF THE DRAWINGS

The invention will be more clearly appreciated with the aid of the following description, with reference to the appended schematic drawing representing, by way of example, an embodiment of this tower crane with collapsible counter-jib.

DESCRIPTION OF THE PREFERRED EMBODIMENTS

Figure 1:
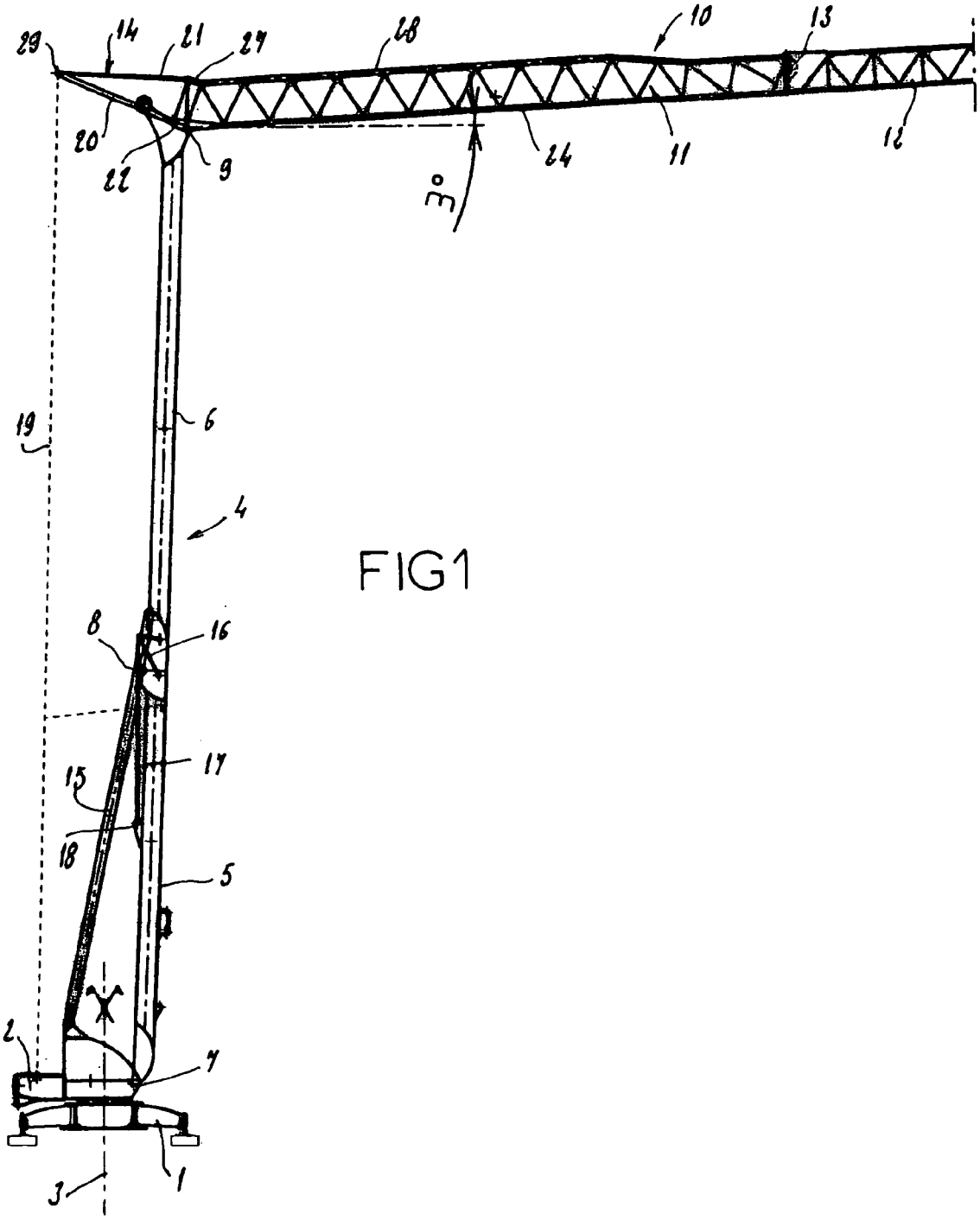
FIG. 1 is a side view of a tower crane according to the present invention in working configuration, the jib (partially represented) being in substantially horizontal position.

FIG. 1 shows a collapsible tower crane, which here includes a fixed bogie truck 1 on which is mounted a revolving underframe 2, which can be directed about a vertical axis 3. The crane includes a collapsible mast 4, composed of two elements 5 and 6, namely a lower mast element 5 and an upper mast element 6. The lower mast element 5 is hinge-connected by its base, about a horizontal axis 7, to the front of the revolving underframe 2. The upper mast element 6 is hinge-connected by its base, about a horizontal axis 8, to the summit of the lower mast element 5.

Hinge-connected to the summit of the upper mast element 6, about another horizontal axis 9, is a jib 10, along which moves a trolley (not represented). The jib 10 is here composed of a jib foot 11 and at least one other jib element 12, the latter being hinge-connected to the front end of the jib foot 11 about a horizontal axis 13. The jib foot 11 possesses a triangular section.

The jib 10 is extended, behind its articulation axis 9 at the summit of the mast 4, by a counter-jib 14, which is here a collapsible counter-jib, described in detail further below.

The crane includes hoisting guys 15 for the mast 4, mounted between the revolving underframe 2 and the lower part of the upper mast element 6. The guys 15 are connected to a motorized drive device for the unfolding/folding-up of the mast 4, composed of a connecting rod assembly 16, situated in the intermediate articulation zone (axis 8) of the mast 4, and a jack 17 connecting the connecting rod system 16 to a point 18 on the lower mast element 5.

Finally, the crane includes a rear tie 19, which connects the rear end of the counter-jib 14 to the rear part of the revolving underframe 2. The rear tie 19 holds the jib 10 in its working position, which can be a substantially horizontal position (as shown in FIG. 1), or an inclined position, more or less raised. This rear tie 19 also drives the unfolding of the jib 10, simultaneously with the unfolding of the mast 4 driven by the device composed of the connecting rod system 16 and the jack 17.

Figure 2:
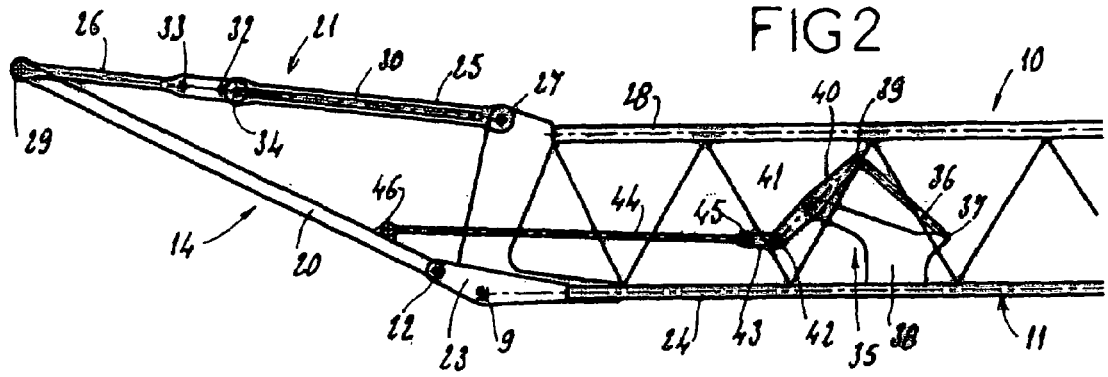
FIG. 2 is a detailed view of the counter-jib and the rear part of the jib of this crane, in the working position of FIG. 1.

Referring to FIG. 2 et seq., a detailed description will now be given of the structure of the counter-jib 14.

The counter-jib 14 possesses a structure in the general shape of a trihedron, comprising a lower part 20 and an upper part 21, which converge toward a rear point.

The lower part 20, in the shape of an elongated isosceles triangle, is hinge-mounted by its base, about a horizontal axis 22, on the rear ends 23 of the two lower chords 24 of the jib 10, more particularly of the jib foot 11.

The upper part 21 of the counter-jib 14 is constituted by a telescopic tie, composed of an anterior element 25 and a posterior element 26. The anterior element 25 is hinge-mounted by its front end, about a horizontal axis 27, on the rear end of the jib foot 11, at the level of its upper chord 28. The posterior element 26 is hinge-mounted by its rear end, about a horizontal axis 29, on the rear end of the lower part 20 of the counter-jib 14, such as to form the rear point of the trihedron.

The anterior element 25 of the upper part 21 of the counter-jib 14 is equipped with a longitudinal slot 30. The posterior element 26 of said upper part 21 is provided with adjusting holes 31, 32 and 33 and is formed such as to offer secure guidance to the sliding motion of the anterior element 25. Finally, a stop pin 34 is provided, positioned in one of the holes 31, 32 or 33 of the posterior element 26, and cooperating with the end of the slot 30.

The rear point of the counter-jib 14, hence the axis 29, is hinge-connected to the upper end of the rear tie 19.

Between the rear part of the jib foot 11 and the counter-jib 14, a motorized device 35 for folding up and controlling the unfolding of this counter-jib 14 is provided. The motorized device 35 is composed, in general terms, of a gas spring 36 and a connecting rod assembly.

The gas spring 36 is hinge-mounted by an end, about a horizontal axis 37, on a support 38 joined to the jib foot 11. The other end of the gas spring 36 is hinge-mounted, about a horizontal axis 39, on one end of a connecting rod 40 belonging to the connecting rod assembly.

The connecting rod assembly includes the connecting rod 40, which is a three-point connecting rod articulated by one end about the axis 39 of the gas spring 36, articulated at an intermediate point about a horizontal axis 41 on the support 38 joined to the jib foot 11 and hinge-mounted by its other end about an axis 42 on a linkage, which latter also belongs to the connecting rod assembly.

The linkage is constituted by two connecting rods, namely a short connecting rod 43 and a long connecting rod 44, mutually hinge-connected in traction along a horizontal axis 45. The short connecting rod 43 is hinge-connected by its front end, about the horizontal axis 42, to the end of the three-point connecting rod 40. The long connecting rod 44 is hinge-mounted by its rear end, about a horizontal axis 46, on the lower part 20 of the counter-jib 14, between the base and the summit of this lower part 20. In the working position of the crane, as shown in FIGS. 2, 3 and 4, the two connecting rods 43 and 44 of the linkage are aligned, by the traction effect itself resulting from the compression of the gas spring 36.

Figure 3:
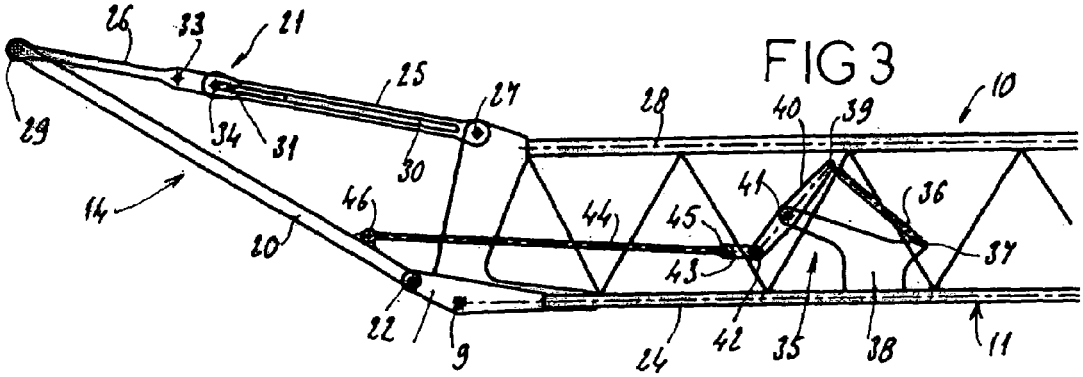
FIG. 3 is a view similar to FIG. 2, but corresponding to an inclined working position of the jib.
Figure 4:
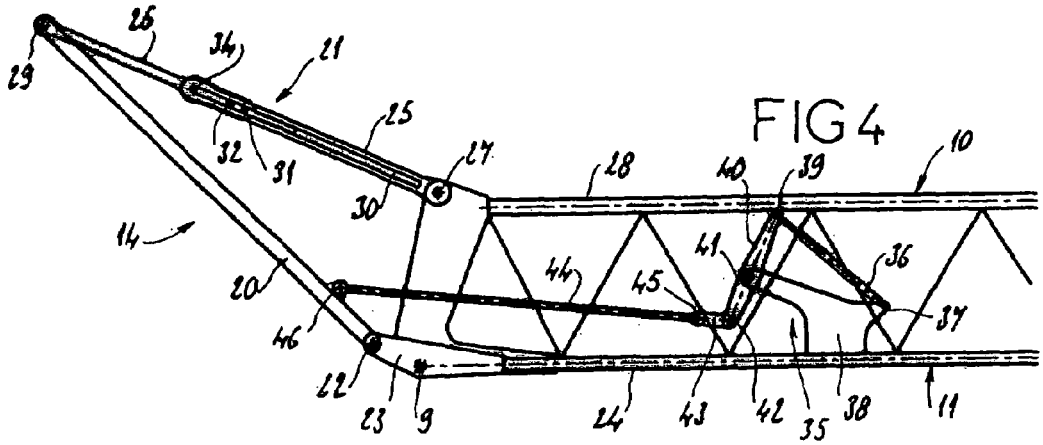
FIG. 4 is a view similar to the two preceding views, corresponding to a more heavily inclined working position of the jib.

More particularly, FIGS. 2, 3 and 4 illustrate various configurations of the counter-jib 14 and the associated connecting rod assembly, corresponding to different positions of the jib 10. These positions are selected, prior to erection of the crane, by adjustment of the length of travel of the telescopic tie, that is to say of the upper part 21 of the counter-jib 14.

For the substantially horizontal position (for example inclined to 3°) of the jib 10, as shown by FIG. 2, the telescopic tie possesses a length of maximum travel, determined by the positioning of the stop pin 34 in the hole 31 situated nearest to the front end of the posterior element 26 of the telescopic tie.

For a slightly raised position of the jib 10, for example a position inclined to 8° (see FIG. 3), the telescopic tie possesses a length of intermediate travel, determined by the positioning of the stop pin 34 in the intermediate hole 32 of the posterior element 26 of the telescopic tie.

For a more elevated position of the jib 10, for example a position inclined to 20° (see FIG. 4), the telescopic tie possesses a minimum length of travel, determined by the positioning of the stop pin 34 in the hole 33 situated nearest to the rear end of the posterior element 26 of the telescopic tie.

It will be evident that FIGS. 3 and 4 do not faithfully reproduce the actual inclination of the jib 10, the principal aim of these figures being to illustrate the variable configurations of the counter-jib 14.

Figure 5:
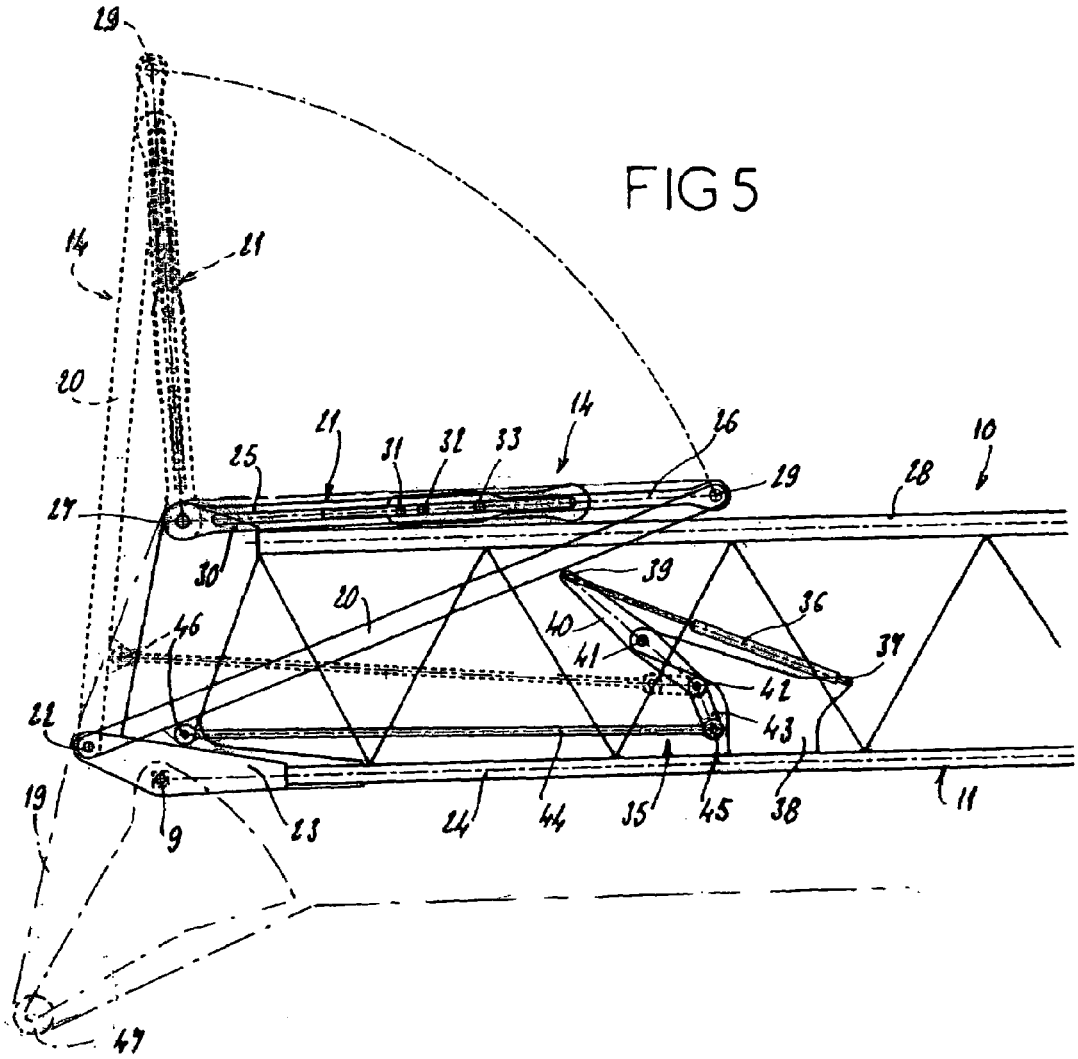
FIG. 5 is another side view of the counter-jib and the rear part of the jib, showing the counter-jib in folded-up transport position and also indicating an intermediate position of this counter-jib in the course of folding-up.

In the transport position of the crane, the counter-jib 14 is folded up on the rear part of the jib foot 11, as illustrated by the continuous line marking of FIG. 5. The triangular lower part 20 of the counter-jib 14, articulated about the horizontal axis 22, is in this case tilted down obliquely on the jib foot 11, its summit (axis 29) being situated just above the upper chord 28 of the jib foot 11. The upper part 21 of the counter-jib 14, articulated about the horizontal axis 27, is tilted down horizontally above the upper chord 28 of the jib foot 11, this upper part 21, formed as a telescopic tie, in this case possessing a reduced length. In the connecting rod assembly, the two connecting rods 43 and 44 of the linkage are no longer aligned but form an angle one with the other.

Figure 6:
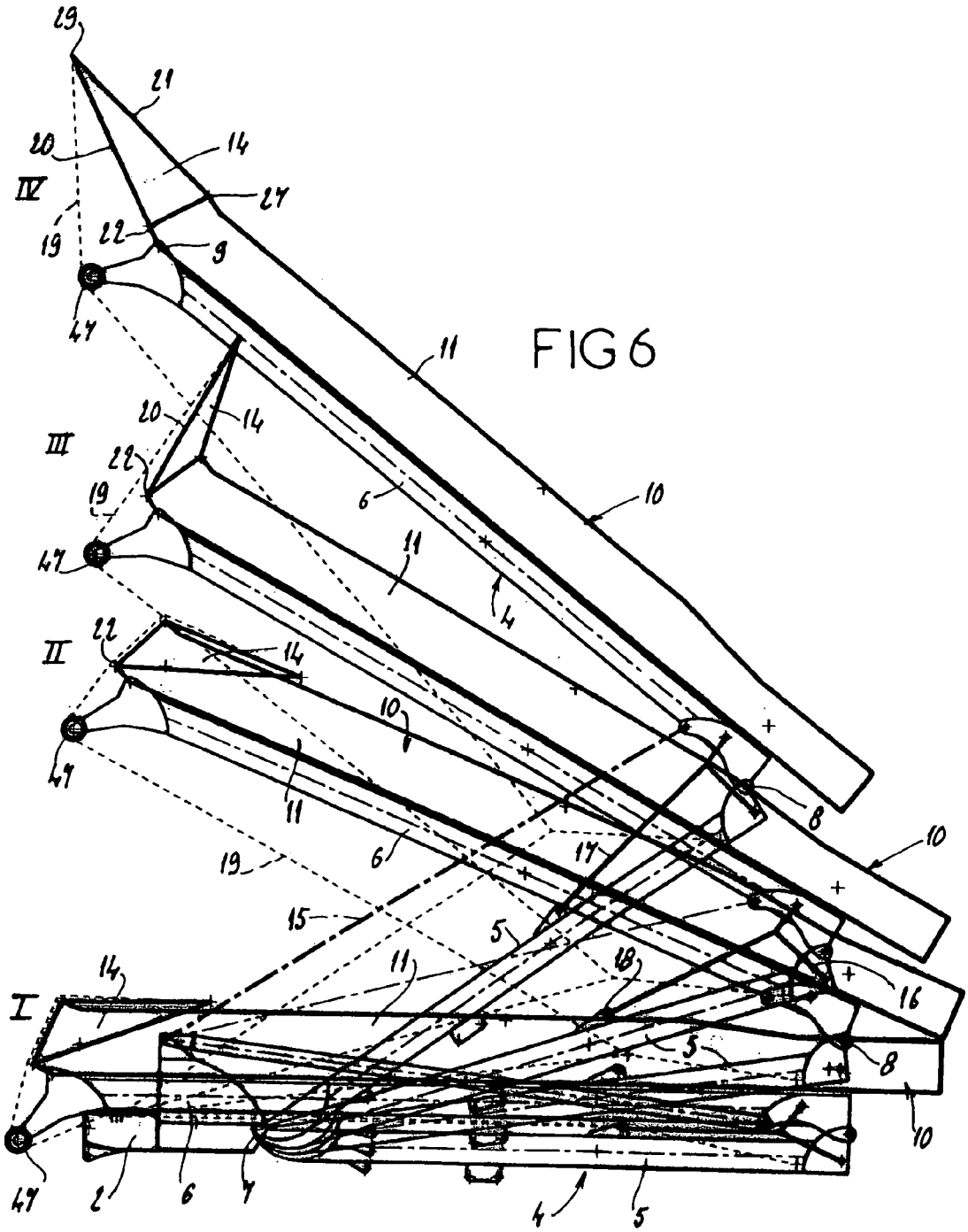
FIG. 6 is a very schematic side view of the jib and counter-jib, illustrating the successive unfolding phases of the counter-jib in the course of an erection sequence of the crane from its folded-up transport position.
Figure 7:
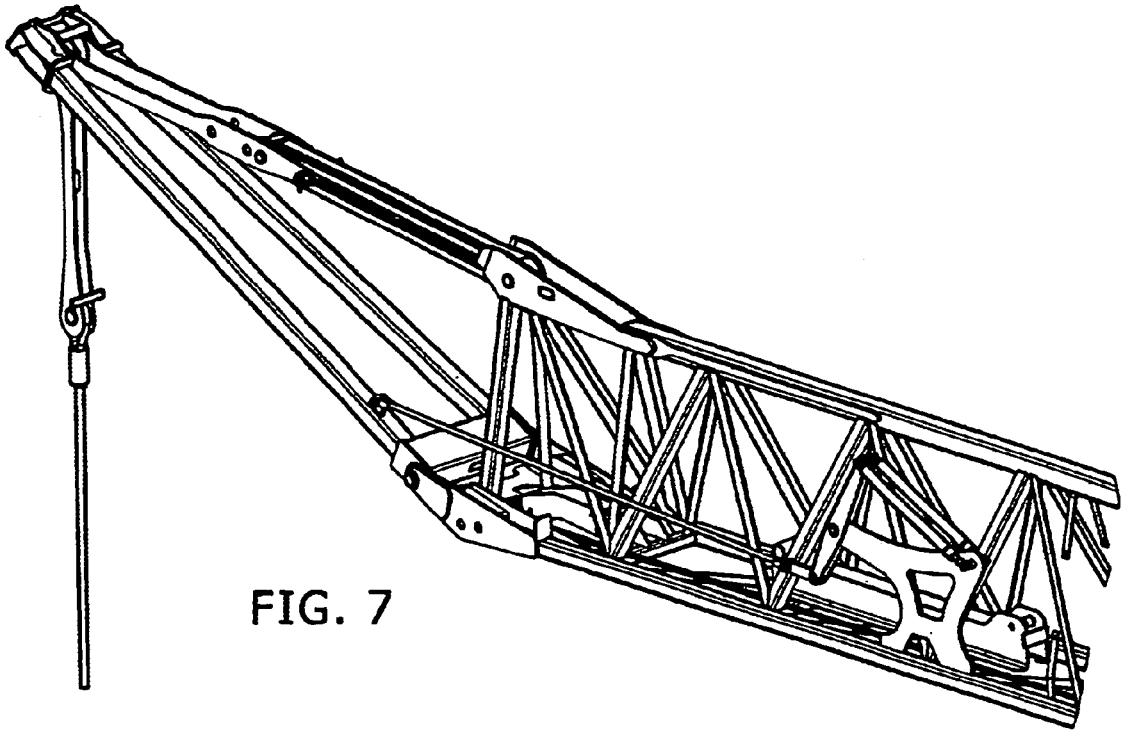
FIG. 7 is an oblique side view of the counter-jib and the rear part of the jib, showing the counter-jib in the unfolded position.
Figure 8:
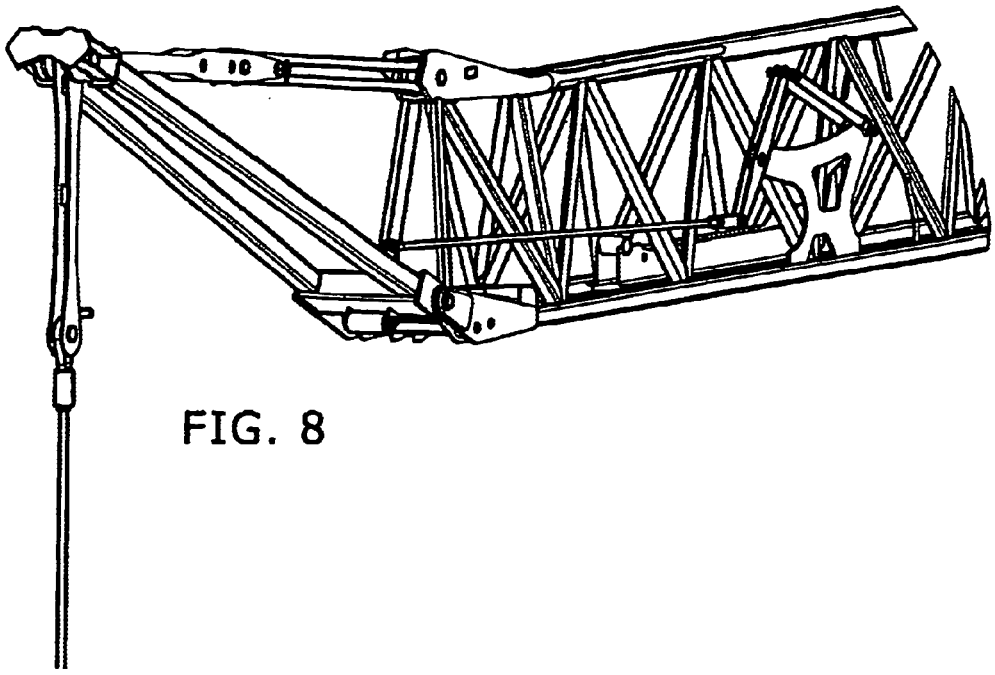
FIG. 8 is a view similar to FIG. 7, but viewed from a different oblique angle.

Referring finally to FIG. 6, a description will now be given of the unfolding sequence of the counter-jib 14 from its previously defined folded-up transport position, said FIG. 6 showing successive positions of the mast 4, the jib 10 and the counter-jib 14 in the course of the erection of the crane.

Initially, in the folded-up transport position, the mast 4 is horizontally folded, its two elements 5 and 6 being superposed, and the jib 10 is horizontally folded on the mast 4, the counter-jib 14 being itself folded up on the rear of the jib foot 11, as previously described. The rear tie 19 is initially without "slack", or at least without appreciable "slack" (see the position marked I).

The drive device for the unfolding/folding-up of the mast 4 is actuated, in a known manner, by its jack 17 being fed in the direction corresponding to the unfolding of the mast 4.

From a certain state of unfolding of the mast 4, the rear tie 19, which passes over a pulley 47 borne by the summit of the mast 4, moves away from this mast 4 and becomes taut. Until then, the counter-jib 14 remains fully folded-up upon the jib foot 11 (see the position marked II).

From this position, as the unfolding of the mast 4 proceeds, the rear tie 19 exerts a traction upon the point of the counter-jib 14 and starts to pivot the lower part 20 of the latter about the horizontal axis 22. The counter-jib 14 is thereupon swung rearward, by rotation of its lower part 20, and by simultaneous rotation and telescoping of its upper part 21. The rearward swinging motion of the counter-jib 14 passes through various intermediate positions (such as the position marked III) and continues up to the stop of the telescopic upper part 21 in the position corresponding to the chosen working configuration of the crane, determined at the outset by the positioning of the pin 34. (See the position marked IV).

Between the fully folded-up position of the counter-jib 14 (from the position I to the position II) and a "slightly forward inclined" position of this counter-jib 14 (position III), the motorized device 35 is inactive. As soon as the counter-jib 14 passes the "slightly forward inclined" position, the motorized device 35 is actuated by the alignment of the two connecting rods 43 and 44 of its linkage and it controls the unfolding motion of the counter-jib 14 by braking this motion, thus keeping the rear tie 19 taut.

From the position IV, the counter-jib 14 having reached its unfolded position, the unfolding of the mast 4 continues up to the alignment of its two elements 5 and 6, and the jib 10, for its part, is fully unfolded, such as to bring the whole of the crane into its working configuration (FIG. 1).

In the course of dismantling of the crane, from this working configuration and up to the position IV in which the jib 10 comes to rest upon the mast 4, the motorized device 35 for folding up the counter-jib 14 is inactive. From the position IV, this motorized device 35 enters into action and then swings the counter-jib 14 forward, by rotation of its lower part 20 about the axis 22, and by simultaneous rotation and telescoping of its upper part 21.

As soon as the counter-jib 14 passes the "slightly forward inclined" position (position III), the motorized device 35 becomes inactive again, following the misalignment of the two connecting rods 43 and 44 of its linkage. Under the effect of its own weight, the counter-jib 14 thereupon pursues its folding-up motion, the rear tie 19 being kept taut up to the position III.

Beyond the particular example illustrated in the drawing, the invention can be applied to any type of auto-erection tower crane: cranes with flexible mast, with telescopic mast, with flexible and telescopic mast; cranes with telescopic jib, with flexible "concertina-type" jib, with flexible "worm" jib; the mast and the jib being able to be composed of a greater or lesser number of elements, of any section.

The scope of the invention, as defined in the appended claims, would not be transcended:

by modifying the shape and structure of the counter-jib;

by modifying, in particular, the structure of the telescopic upper part of the counter-jib in order to obtain different raised positions, and a greater or lesser number of positions, of the jib;

by modifying the details of the motorized device for folding up and controlling the unfolding of the counter jib, for example by modifying the configuration of its connecting rod assembly or by replacing the gas spring by any equivalent member, such as a mechanical spring or an electrically, hydraulically or pneumatically powered jack.

The invention claimed is:

1. An auto-erecting tower crane, comprising:

a bogie truck;

a mast having a base and a summit, wherein the base is connected to the bogie truck;

a jib having a rear end and connected to the mast summit; and a counter-jib having anterior and posterior ends with no tie or cable connecting the counter-jib posterior end to a middle or a far end of the jib, wherein the counter-jib anterior end is articulately connected to the jib rear end, wherein the counter-jib has a folded orientation positioning the counter-jib posterior end near the jib and at least one unfolded orientation positioning the counter-jib posterior end away from the jib, and wherein the counter-jib traverses a vertical plane when moved between the folded and unfolded orientations.

2. The auto-erecting tower crane of claim 1, further comprising a motorized device having a gas spring and a connecting rod assembly for controlling at least part of the movement of the counter-jib between the folded and unfold orientations, the motorized device being mounted at the rear end of the jib.

3. The auto-erecting tower crane of claim 2, wherein the gas spring articulately connects the jib to a three-point connecting rod, wherein the connecting rod articulately connects the jib to a linkage, wherein the linkage articulately connects the connecting rod to the lower part of the counter-jib, and wherein the linkage comprises a short connecting rod and a long connecting rod.

4. The auto-erecting tower crane of claim 1, wherein the mast comprises two articulated elements, and wherein the movement of the counter-jib between the folded and unfolded orientations is contemporaneous with the erection of the crane.

5. The auto-erecting tower crane of claim 1, wherein the counter-jib comprises a lower part and a telescopic upper part that are each articulately connected on substantially horizontal axes to the jib rear end at the counter-jib anterior end.

6. The auto-erecting tower crane of claim 5, wherein the telescopic upper part of the counter-jib comprises means for adjusting the telescoping travel of the telescopic upper part, for preselection of the horizontal position or of more or less inclined positions of the jib in a working configuration of the crane.

7. The auto-erecting tower crane of claim 6, wherein the telescopic upper part is a telescopic tie comprising at least two longitudinally aligned elements and said means for adjusting the telescoping travel comprise, on one of the elements of the telescopic tie, a longitudinal slot and, on another element of the telescopic tie, a plurality of adjusting holes provided to receive a stop pin cooperating with an end of the longitudinal slot.

8. The auto-erecting tower crane of claim 5, wherein the counter-jib is in the form of a trihedron such that the counter-jib lower part has the form of an isosceles triangle with a summit at the counter-jib posterior end and a base at the counter-jib anterior end, and wherein the counter-jib telescopic upper part is a telescopic tie comprising an anterior element articulately connected at the counter-jib anterior end to the jib rear end and a posterior element articulately connected to the summit of the counter-jib lower part.

9. The auto-erecting tower crane of claim 8, wherein the longitudinal cross-section of the jib is in the form of a triangle with two longitudinal lower chords and one longitudinal upper chord, wherein the lower part base of the counter-jib is articulately connected to the lower chords at the jib rear end and the anterior element is articulately connected to the upper chord at the jib rear end, and wherein in the folded orientation the counter-jib lower part is at an oblique angle to the lower chords and the counter-jib upper part is aligned with the upper chord.

10. An auto-erecting tower crane, comprising:

a bogie truck;

a mast having a base and a summit, wherein the base is connected to the bogie truck;

a jib having a rear end and connected to the mast summit;

a counter-jib having anterior and posterior ends with no tie or cable connecting the counter-jib posterior end to a middle or a far end of the jib, wherein the counter-jib anterior end is articulately connected to the jib rear end, wherein the counter-jib has a folded orientation positioning the counter-jib posterior end near the jib and at least one unfolded orientation positioning the counter-jib posterior end away from the jib, and wherein the counter-jib traverses a vertical plane when moved between the folded and unfolded orientations; and a motorized device for controlling at least part of the movement of the counter-jib between the folded and unfold orientations, the motorized device being mounted at the rear end of the jib.

11. An auto-erecting tower crane, comprising:

a bogie truck;

a mast having a base and a summit, wherein the base is connected to the bogie truck;

a jib having a rear end and connected to the mast summit;

a counter-jib having anterior and posterior ends with no tie or cable connecting the counter-jib posterior end to a middle or a far end of the jib, wherein the counter-jib anterior end is articulately connected to the jib rear end, wherein the counter-jib has a folded orientation positioning the counter-jib posterior end near the jib and at least one unfolded orientation positioning the counter-jib posterior end away from the jib, and wherein the counter-jib traverses a vertical plane when moved between the folded and unfolded orientations; and a motorized device for controlling at least part of the movement of the counter-jib between the folded and unfold orientations, the motorized device being mounted at the rear end of the jib, wherein the motorized device comprises a gas spring and a connecting rod assembly, wherein the gas spring articulately connects the jib to a three-point connecting rod, wherein the connecting rod articulately connects the jib to a linkage, and wherein the linkage articulately connects the connecting rod to the lower part of the counter-jib.

* * * * *